US005603202A

United States Patent [19]

Hanagata

[11] Patent Number: 5,603,202

[45] Date of Patent: Feb. 18, 1997

[54] MACHINE FOR WRAPPING ARTICLES WITH A BELT-LIKE FILM OR THE LIKE

[75] Inventor: Toshiyuki Hanagata, Toyama-ken, Japan

[73] Assignee: Hanagata Corporation, Toyama-ken, Japan

[21] Appl. No.: 402,013

[22] Filed: Mar. 10, 1995

[30] Foreign Application Priority Data

May 27, 1994 [JP] Japan ..... 6-114831

[51] Int. Cl.[6] ..... B65B 9/06

[52] U.S. Cl. ..... 53/550; 53/228; 53/562; 53/568

[58] Field of Search ..... 53/455, 562, 568, 53/459, 466, 228, 229, 550; 493/302

[56] References Cited

U.S. PATENT DOCUMENTS

| | | | |
|---|---|---|---|
| 3,339,337 | 9/1967 | Rapp et al. | 53/562 |
| 3,583,888 | 6/1971 | Sharklin | 53/568 |
| 3,597,895 | 9/1969 | Jensen | 53/562 |
| 3,732,789 | 5/1973 | Hartleib | 53/562 |
| 4,219,988 | 9/1980 | Shanklin et al. | 53/568 |
| 4,939,889 | 7/1990 | Watanabe | 53/550 |
| 5,235,792 | 8/1993 | Hanagata | 53/568 |

FOREIGN PATENT DOCUMENTS

| | | |
|---|---|---|
| 60-2914 | 1/1985 | Japan . |
| 4-102508 | 4/1992 | Japan . |
| 4-102509 | 4/1992 | Japan . |

*Primary Examiner*—Lowell A. Larson
*Assistant Examiner*—Gene L. Kim
*Attorney, Agent, or Firm*—Hill, Steadman & Simpson

[57] ABSTRACT

A machine for wrapping an article with a belt-like wrapping material of film, synthetic resin laminate or the like, includes a folding and opening unit having a length about a half of the wrapping material. The unit comprises an inverting guide, a raising guide, and a folding guide. The inverting guide has a straight inverting and guiding section transversely crossing the wrapping material at a right angle and a virtually straight slant guiding section connected with one end of the inverting and guiding section and inclined by about 45°. The raising guide is included in a fixed horizontal plane defined by the inverting guide and crosses a meeting point of both guiding sections at a right angle for raising the wrapping material at about a right angle. The folding guide is situated upwardly of a substantially vertical plane which includes the raising guide and has a virtually right-angled equilateral triangle which is located in a plane parallel to the fixed horizontal plane, and has one side extending between an apex on a straight line rising at about 45° with respect to the meeting point and another apex which is right-angled and an inclined side. With this folding and opening unit, the wrapping material is folded and inverted longitudinally, and simultaneously the wrapping material is opened in U-shape cross section to receive the article. Then the wrapping material with the article is fed horizontally forwardly, and the openings of the folded material are fused and cut.

15 Claims, 8 Drawing Sheets

MACHINE FOR WRAPPING ARTICLES WITH A BELT-LIKE FILM OR THE LIKE

BACKGROUND OF THE INVENTION

1. Field of the Invention

This invention relates to a wrapping machine which is equipped with a folding and opening unit for drawing a wide wrapping material of film, synthetic resin laminate or the like from a roll, continuously folding the wrapping material longitudinally about its center line and, at the same time, opening the folded wrapping material, and then conveying the resulting wrapping material to a subsequent station.

2. Description of the Related Art

Wrapping machines most similar to the continuous wrapping machine of the type described above are disclosed in, for example, Japanese Patent Publication No. SHO 60-2914, Japanese Patent Laid-Open Publication No. HEI 4-102508 and Japanese Patent Laid-Open Publication No. HEI 4-102509. FIG. 10 of the accompanying drawings illustrates the principle of a folding unit of the individual prior art wrapping machine for continuously folding a wrapping material such as of film (hereinafter called the film), which is to be continuously supplied from a roll, longitudinally about its center line.

The known folding unit comprises a first guide 100 having a horizontal guide section 101, which is situated above a rotatable horizontal film roll FR in parallel to its roll shaft and has a length about a half of the film F, and an inclined guide section 102, which is connected to one end of the horizontal guide section 101 and is inclined downwardly by about 45°, and a second guide 200 having at least an inclined guide section 201, which is situated close to the front side in a supplying direction of the first guide 100 and is inclined downwardly by about 45° from the upper end of the inclined guide section 102 to below the free end of the horizontal guide section 101, and a non-illustrated guide roller situated under the inclined guide section 201 of the second guide 200 in parallel to the roll shaft and having a length at least about a half of the width of the wrapping material.

In the horizontal guide section 101 and the inclined guide section 102 of the first guide 100, one half of the wide film F to be drawn vertically upwardly from the film roll FR is turned at an angle of 180° downwardly, while the other half width of film F is turned downwardly at an angle of 45° and again turned vertically downwardly from inside to outside around the inclined guide section 201 of the second guide 200 situated upstream of and close to the horizontal guide section 101 of the first guide 100. While the film F is moved forwardly along a longitudinal path, it is folded longitudinally about its center line; one half width of the film F is directed downwardly via the horizontal guide section 101 of the first guide 100, and the other half width of the film F is directed forwardly via the inclined guide section 201 of the second guide 200, whereupon the folded film F is then turned in the horizontal direction as guided by the non-illustrated guide roller, and is transferred to the next station.

In the prior art wrapping machine, the folded film F-1, F-2 is turned by a right angle while it is opened by a non-illustrated opening device of the next station so as to have a generally horizontal U-shape cross section. Into this opening of the film turned by a right angle, articles to be wrapped are conveyed one after another at predetermined intervals by a non-illustrated belt conveyer inserted longitudinally (as indicated by an arrow Y) of the wrapping machine. Then the folded film F is fused and cut at two side openings around the article by a non-illustrated L-type sealer.

However, in the wrapping machine disclosed in the above-mentioned prior art references as well as any other continuous wrapping machine in this kind, the film folding device is connected with a film opening device for opening the folded film. With this structure, when the folded film is opened by drawing, static electricity would occur due to friction during taking up of the film, and blockage would occur due to adhesion of films. As a result, the prior art continuous wrapping machine requires an increased number of component devices which not only needs an increased space for installation of all the devices but also gives large influence to the cost of installation, operation management, etc.

SUMMARY OF THE INVENTION

A first object of this invention is to develop a single composite unit in which a film folding device and a film opening device are combined.

A second object of the invention is to realize a compact wrapping machine equipped with the above-mentioned composite unit.

A third object of the invention is to provide a practical wrapping machine which can cope with a variety of sizes of articles to be wrapped, without using different machines.

In order to solve the foregoing problems, a machine for wrapping an article with a belt-like wrapping material of film or the like is provided which comprises: a roll of continuous-length wrapping material such as film or synthetic resin laminate; a folding and opening unit for inverting the continuous-length wrapping material, which is drawn out horizontally from the roll, folding the drawn-out wrapping material longitudinally about its center line and, at the same time, opening the folded wrapping material in a generally horizontal U-shape cross section; means facing toward the inside of the folding and opening unit for supplying an article to be wrapped; and means for fusing and cutting the opening of the folded wrapping material supplied from the folding and opening unit.

Preferably, the folding and opening unit has means for adjustably positioning the folding and opening unit transversely of the wrapping material, and means for heat shrinking the fused wrapping material accommodating the article, wherein the wrapping material roll is situated under the folding and opening unit, and the fusing and cutting means downstream of the wrapping material and the heat shrinking means are arranged within the entire width of the wrapping material.

More specifically, the folding and opening unit includes: an inverting guide having a straight inverting and guiding section transversely crossing the wrapping material at a right angle and having a length about a half of the width of the wrapping material and a virtually straight slant guiding section, which has a width equal to that of the inverting and guiding section, is connected with one end of the inverting and guiding section and is inclined by about 45°; a raising guide included in a fixed horizontal plane defined by the inverting guide and crossing the meeting point of both guiding section of the inverting guide at right angle for raising the wrapping material at about a right angle; and a folding guide situated upwardly of a substantially vertical plane which includes the raising guide and having a virtually right-angled equilateral triangle which is located in a plane parallel to the fixed horizontal plane, has one side extending between an apex on a straight line rising at about 45° with respect to the meeting point and another apex which is right-angled and an inclined side.

Further, the folding guide has means for adjusting the position of the first-named apex on the straight line rising at about 45° in the vertical plane, and the folding and opening unit further has means for adjustably positioning the folding and opening unit transversely of the wrapping material. Preferably, the fusing and cutting means is an L-type sealer for fusing and cutting the opening edges of the folded wrapping material in L shape simultaneously; if the film is thermoshrinking, means for heat shrinking the film may be situated downstream of the article.

The folding and opening unit of the continuous wrapping machine in operation according to this invention will now be described with reference to FIG. 4, which schematically shows the manner in which the wide film F is folded longitudinally about its center line and, at the same time, the folded film F is opened.

First of all, for setting the wide film F drawn from the film roll FR in the individual guides 2, 3, 4, the film F is guided along the lower surface of the inverting guide 2, and then one half width of the film F is turned by 180° along the upper surface of the inverting guide section 2-1 of the inverting guide 2 while the other half width of the film F is turned to the upper side along the inclined guide section 2-2. This other half-width film F turned to the outer side along the inclined guide section 2-2 is raised vertically after passing under the raising guide 3 and is then turned by a right angle along the upper surface of the folding guide 4, whereupon the other half-width film F is turned back by 180° to the inner side along the inclined side 4*a* of the folding guide 4. As a result, an opening having a generally horizontal U-shape cross section is formed by the inverting guide 2, the raising guide 3 and the folding guide 4.

When the height of the article is changed, assuming that the folding guide 4 is moved in such a manner that its inverting-guide-side apex is moved upwardly and downwardly and forwardly and backwardly along an inclined straight line rising upwardly by about 45° from the meeting point (o) of the inverting guide section 2-1 and the inclined guide section 2-2 of the inserting guide 2 in a vertical plane passing the meeting point (o), the film F is discharged smoothly by the individual guides 2, 3, 4, with the horizontal U-shape cross section kept in a predetermined height, due to the drawing tension. The reason why the locus of the folding guide 4 is along the inclined straight line rising at 45° is as follows: as shown in FIG. 5, by turning one side 3*a'* which makes a right angle of the guide 4' in the form of a right-angled triangular plate by a desired angle θ about the inclined guide section 2-2 of the inverting guide 2, an opening will be formed between the inverting guide 2 and the raising guide 4'. At that time, since one half width of the film F to be inverted by the inclined guide section 2-2 of the inverting guide 2 is raised gradually, the opening edge of the folded film half F-1 to be turned inwardly along an inclined side 4*a'* of the guide 4' and to be forwarded in parallel to the inverting guide 2 comes off gradually from the film travelling path so that the edges of the folded film half F-1 and the folded film half F-2 which is turned by the inverting guide section 2-1 of the inverting guide 2 will be twisted, thus making smooth drawing of the folded film from the folding and opening unit 1' impossible.

For changing the height of the opening to meet the change of height of the article, a folding and opening unit having a position adjusting mechanism should be used. FIG. 6 shows an example of the position adjusting mechanism in the form of an operating handle 5. If a block 7 fastened to a screw rod 6 fixed at 45° is moved along the screw rod 6 by turning the operating handle 5, the folding guide is independently moved along the screw rod 6 together with the block 7, keeping its horizontal posture, so that the height of the opening above the horizontal plane including the inverting guide will be changed and, at the same time, the folding guide will be moved forwardly and backwardly. As a result, no guide for guiding part of film directly exists between the meeting point (o) of the inverting guide section and the inclined guide section of the inverting guide and the apex (o') of the folding guide 4. Since the meeting point (o) and the apex (o') are located in a common straight line raising by 45' from the meeting point (o) in a vertical plane including the raising guide, it is possible to form an opening of the film without difficulty even in a portion where no guide exists due to the drawing tension of the folded film.

The article supply device supplies articles intermittently one after another into the film opening of a generally horizontal U-shape cross section, whereupon the film openings around the respective articles are fused and cut successively by the L-type sealer to provide airtightly wrapped products.

DETAILED DESCRIPTION

Figure 1:
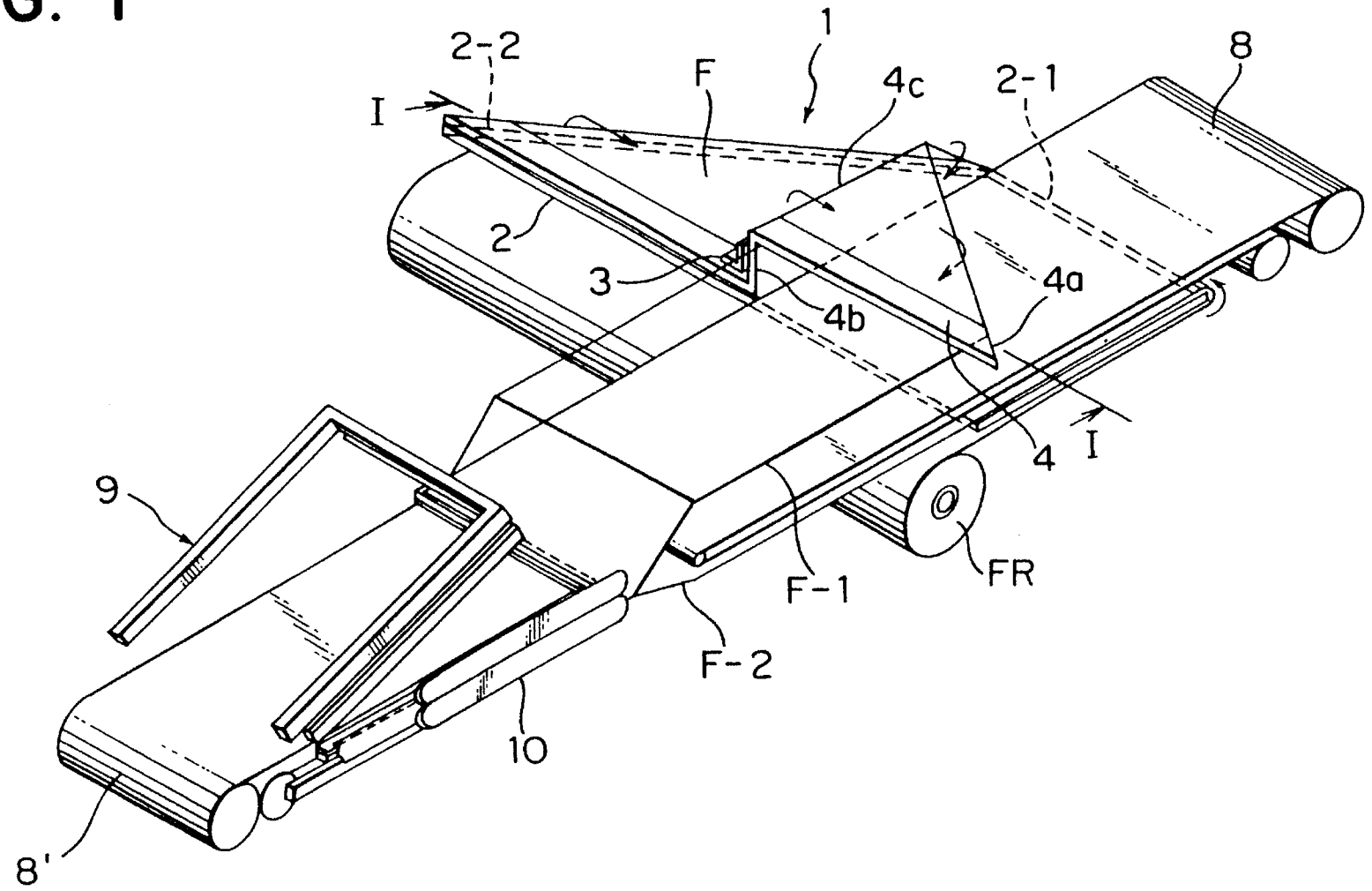
FIG. 1 is a perspective view of an automatic wrapping machine according to a first embodiment of this invention.
Figure 2:
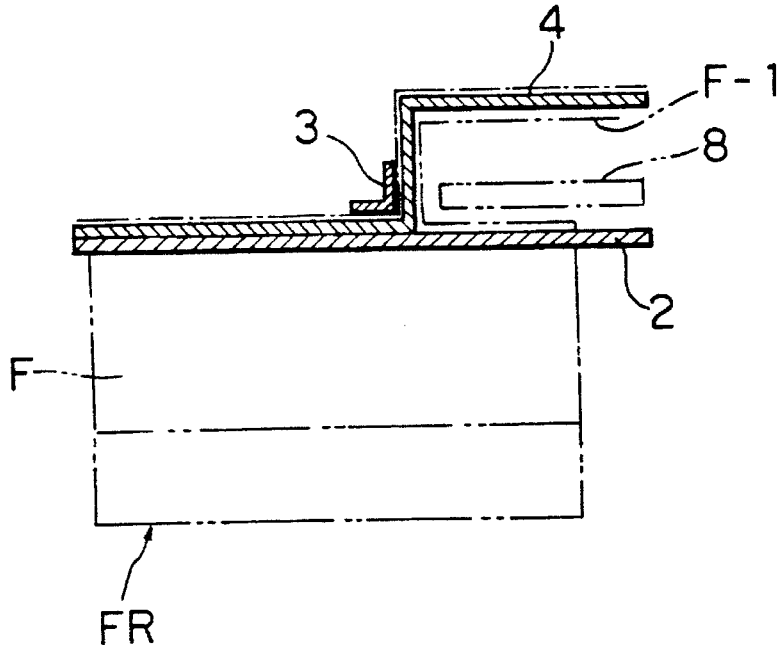
FIG. 2 is a cross-sectional view taken along line I—I of FIG. 1.
Figure 3:
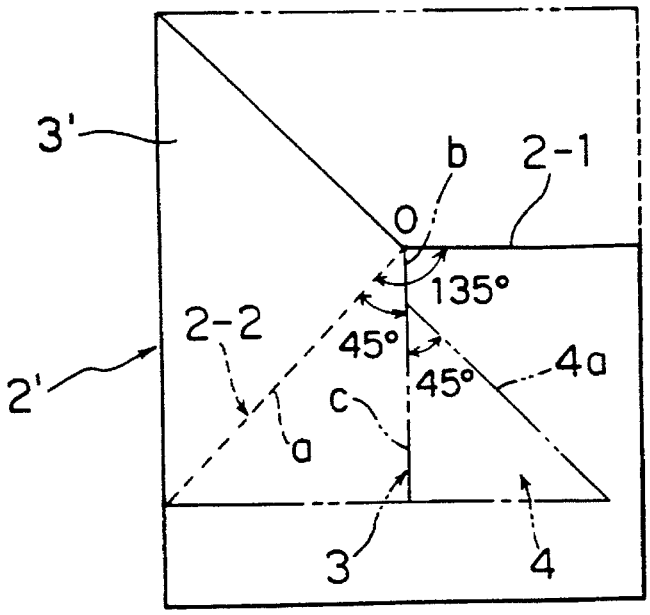
FIG. 3 is a fragmentary expansion view of guides of a film folding and opening unit according to the invention.
Figure 4:
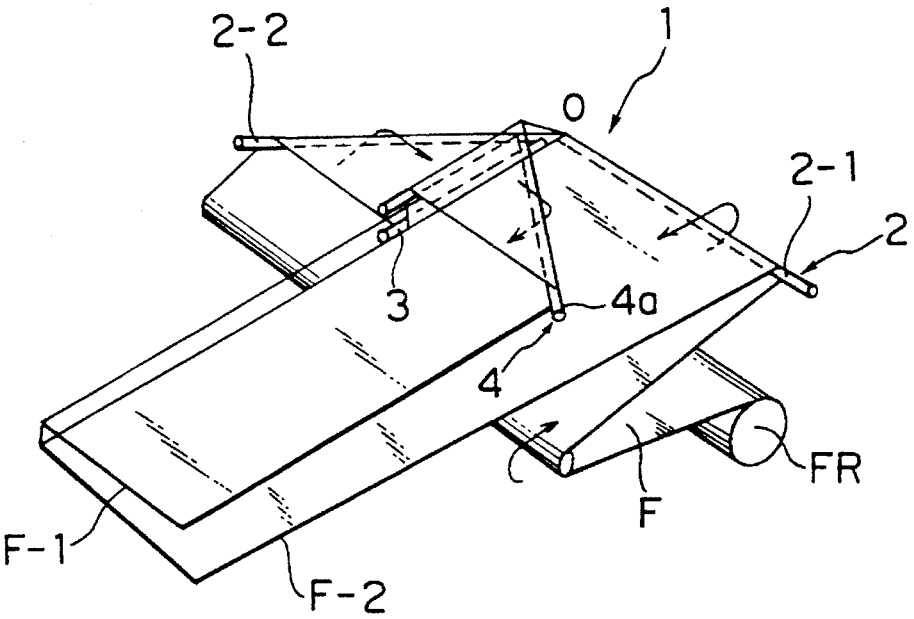
FIG. 4 is a schematic view showing the manner in which the folding and opening unit folds a wide film about its longitudinal center line and opens the folded film.
Figure 5:
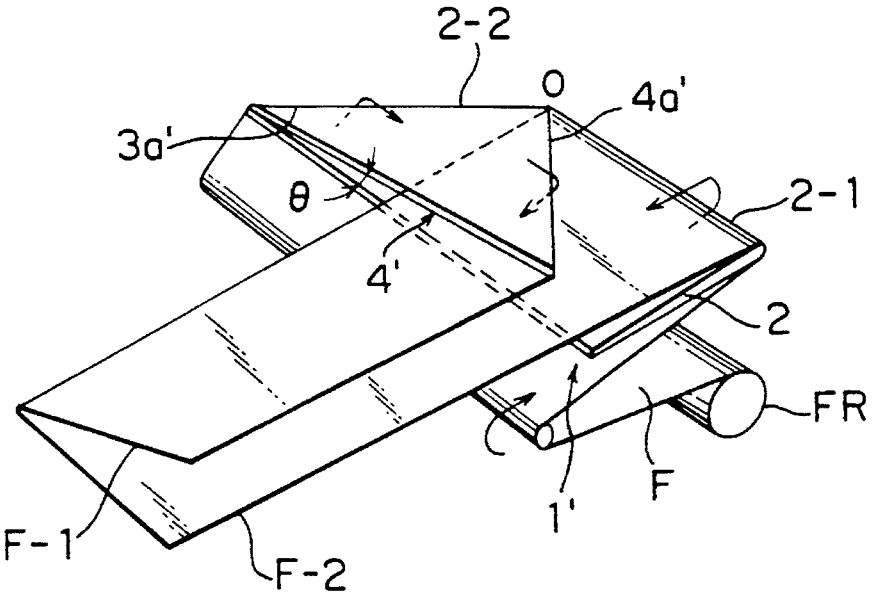
FIG. 5 is a schematic view showing an inconvenience when no raising structure is used in the folding and opening unit.

Embodiments of this invention will now be described with reference to the accompanying drawings. FIG. 1 is a perspective view of an automatic wrapping machine according to a typical embodiment of the invention; FIG. 2 is a cross-sectional taken along line I—I of FIG. 1, showing a film folding and opening unit of the wrapping machine; and FIG. 3 is an expansion view of guides constituting the folding and opening unit.

The most significant feature of this wrapping machine is a film folding and opening unit. In the illustrative example, the main part of the film folding and opening unit 1 comprises a single plate of metal or hard plastics. Specifically, the shape of blank of the film folding and opening unit 1 is such that as shown in FIG. 3, a single virtually square plate, from which a trapezoidal portion having one side which is indicated by a phantom line as the bottom side, another side which is indicated by dotted line meeting at a right angle as the height, and a length a half of one side of the square as the top side is cut off. The blank 2', as shown in FIG. 3, is bent by 180° along a bending line (a) extending obliquely downwardly by 135° from the meeting point (o) of the top side and the inclined side of the trapezoid and is bent by a right angle in a direction opposite to the bending line (a) along a bending line (b) extending horizontally from the meeting point (o) and is further bent by a right angle in a direction opposite to the bending line (b) along a bending line (c) spaced a predetermined distance from and parallel to the bending line (b). Thus part of the film folding and opening unit 1 according to this embodiment of FIG. 1 is constructed.

A part of the film folding and opening unit 1 is composed of a film inverting guide 2 and a film folding guide 4. The film inverting guide 2 has, as shown in FIGS. 1 through 3, a straight inverting guide section 2-1 having a length about a half width of the film, and an inclined guide section 2—2 inclined in a downstream direction by about 45° and connected to the inverting guide section 2-1. The folding guide 4 has a right-angled equilateral triangular shape composed of an inclined guide section 4*a* having at an end an apex of about 45°, a raising guide wall 4*b*, and one side having the same length as an upper side turnover portion 4*c* of the raising guide wall 4*b* and having a right angle at an end. Further, the film folding and opening unit 1 also includes a raising guide 3 independently of the plate having a small gap, which is enough to allow the film F to pass through, between the raising guide wall 4*b*, which is formed between the bending line (b) and the bending line (c) and the front surface toward the inclined guide 2—2. The raising guide 3 is in the form of a plate having an L-shape cross section as shown in FIG. 1.

Figure 6:
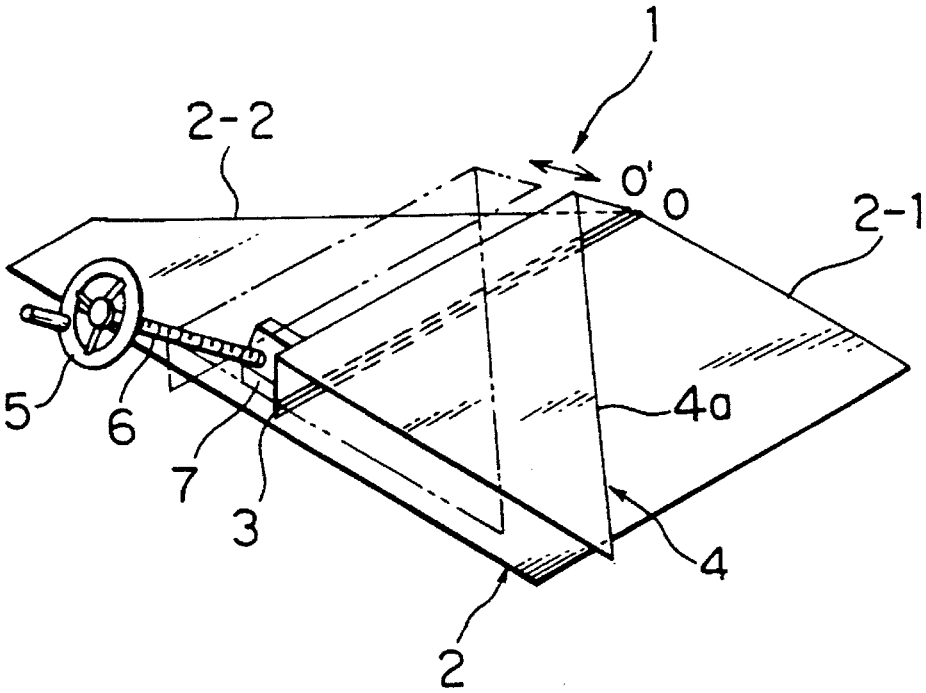
FIG. 6 is a schematic view showing a position adjusting mechanism for adjustment to meet the change of height of articles to be wrapped.

In this embodiment, the essential components of the film folding and opening unit 1 are the inverting guide 2 composed of the inverting guide section 2-1 and the inclined guide section 2-2, the raising guide 3, and the folding guide 4. As long as it has these guides, the film folding and opening unit 1 should by no means be limited to the foregoing construction, and all of the guides may be in the form of rods or freely rotatable rollers. If these guides are thus separate members, the inverting guide 2 and the raising guide 3 may be fixed relative to each other. And the apex (o') of the folding guide may be adjustably moved in a vertical plane including the raising guide 3 along the inclined line rising by about 45° from the meeting point (o) of the inverting guide section 2-1 and the inclined guide section 2-2. In an example of this position adjusting mechanism, as shown in FIG. 6, a screw rod 6 having at one end an operating handle 5 is rotatably mounted parallel to the inclined line, and a block 7 having an internal screw threadedly connected to the screw rod 6 is fixed to the folding guide 4 so as to keep the folding guide 4 in a horizontal posture. The position adjusting mechanism also should by no means be limited to the illustrated example.

FIGS. 1 through 3 illustrates the process in which a wide film F is folded and opened simultaneously on the continuous wrapping machine of this invention.

First of all, for setting the wide film F drawn from the film roll FR in the individual guides 2, 3, 4, the film F is guided along the lower surface of the inverting guide 2, and then one half width of the film F is turned by 180° along the upper surface of the inverting guide section 2-1 of the inverting guide 2 while the other half width of the film F is turned to the upper side along the inclined guide section 2-2. This other half-width film F turned to the outer side along the inclined guide section 2-2 is raised vertically after passing under the raising guide 3 and is then turned by a right angle along the upper surface of the folding guide 4, whereupon the other half-width film F is turned back by 180° to the inner side along the inclined side 4*a* of the folding guide 4. As a result, an opening having a generally horizontal U-shape cross section is formed by the inverting guide 2, the raising guide 3 and the folding guide 4.

For changing the height of the opening to meet the change of height of the article, the position adjusting mechanism of FIG. 6 is used. Assuming that the height of non-illustrated articles is changed, if the block 7 fastened to a screw rod 6 fixed at 45° is moved along the screw rod 6 by turning the operating handle 5, the folding guide 4 is independently moved along the screw rod 6 together with the block 7, keeping its horizontal posture, so that the height of the opening above the horizontal plane including the inverting guide 2 will be changed and, at the same time, the folding guide 4 will be moved forwardly and backwardly. As a result, no guide for guiding part of film directly exists between the meeting point (o) of the inverting guide section and the inclined guide section of the inverting guide and the apex (o') of the folding guide 4. Since the meeting point (o) and the apex (o') are located in a common straight line raising by 45' from the meeting point (o) in a vertical plane including the raising guide 3, it is possible to form an opening of the film F without difficulty even in a portion where no guide exists due to the drawing tension of the folded film.

In the continuous wrapping machine according to the embodiment of FIG. 1, a conveyer belt 8 for supplying articles is situated between the inverting guide 2 and the folding guide 4, extending through the film folding and opening unit 1. The conveyer belt 8 supplies articles intermittently one after another into the opening which is defined between the upper and lower halves F-1, F-2 of the folded film F and which is formed by the film folding and opening unit 1. At the downstream side of the film folding and opening unit 1, an L-type sealer 9 having an L-shape seal bar is situated for fusing and cutting the upstream opening and the longitudinal opening edge of the film halves F-1, F-2, and a conveyer 8' for conveying the folded film F-1, F-2 accommodating the article and a vertical pair of chain feeders 10 for drawing the folded film F from the film folding and opening unit 1 with gripping the opening edge of the film from upper and lower sides are arranged.

According to this continuous wrapping machine, when the individual article is supplied into the folded and opened film F from the conveyer 8 which is intermittently rotated by a non-illustrated drive unit such as a motor, the conveyer 8' and the chain feeders 10 are driven likewise by a non-illustrated drive unit to draw the folded film F-1, F-2 to the downstream side by a predetermined length and then to stop the folded film F. This intermittent driving is detected and controlled by, for example, a limit switch or an encoder. Now assuming that the driving is interrupted, the L-type sealer 9 is activated to fuse and cut the two sides, i.e. longitudinal and transverse, of the upper and lower halves F-1, F-2 of the folded film, and then the conveyer 8' and the chain feeders 10 are driven to draw the next folded film F-1, F-2 and to discharge the sealed article to the next station.

Figure 7:
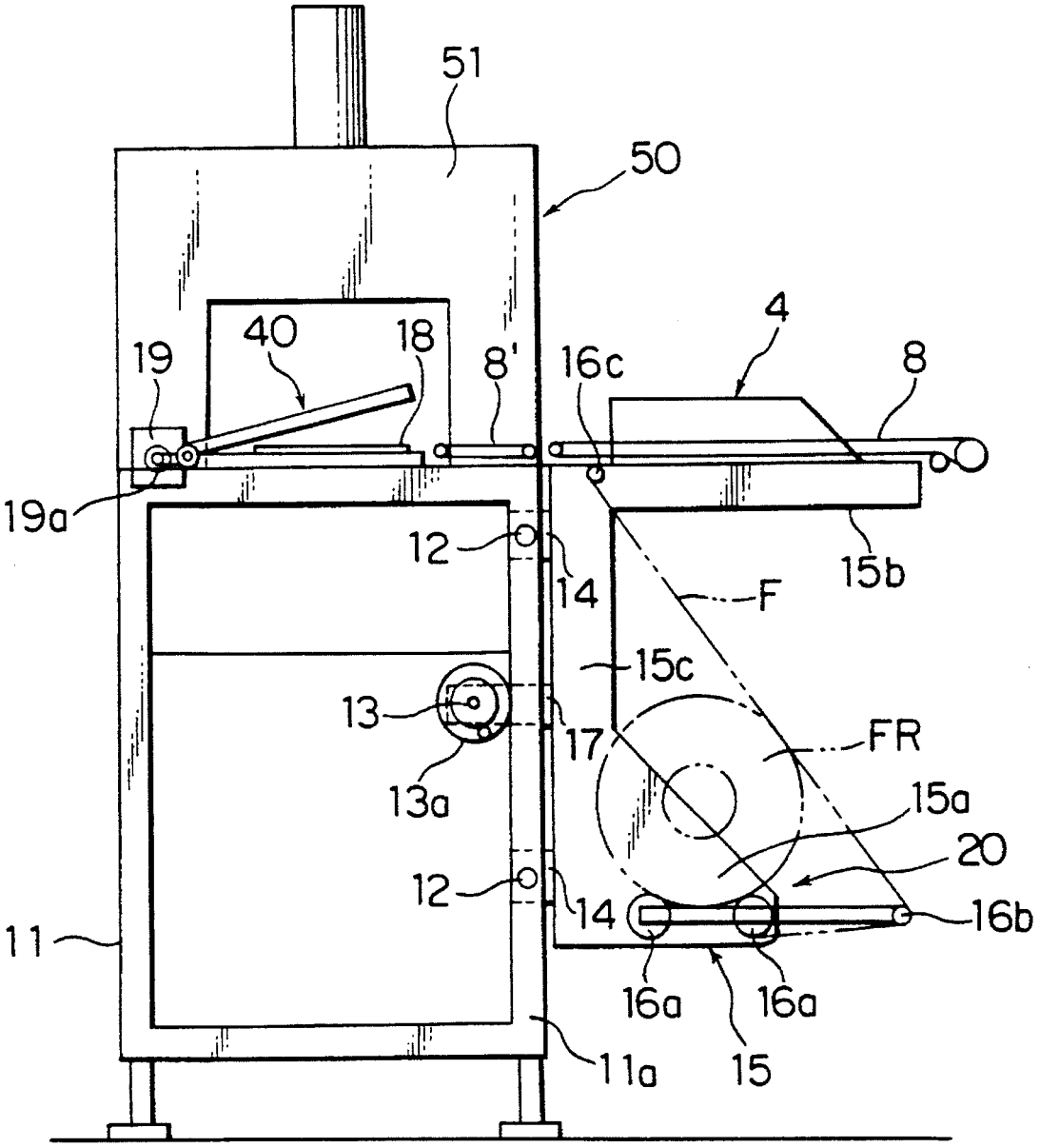
FIG. 7 is a side view of an automatic wrapping machine according to a second embodiment.
Figure 8:
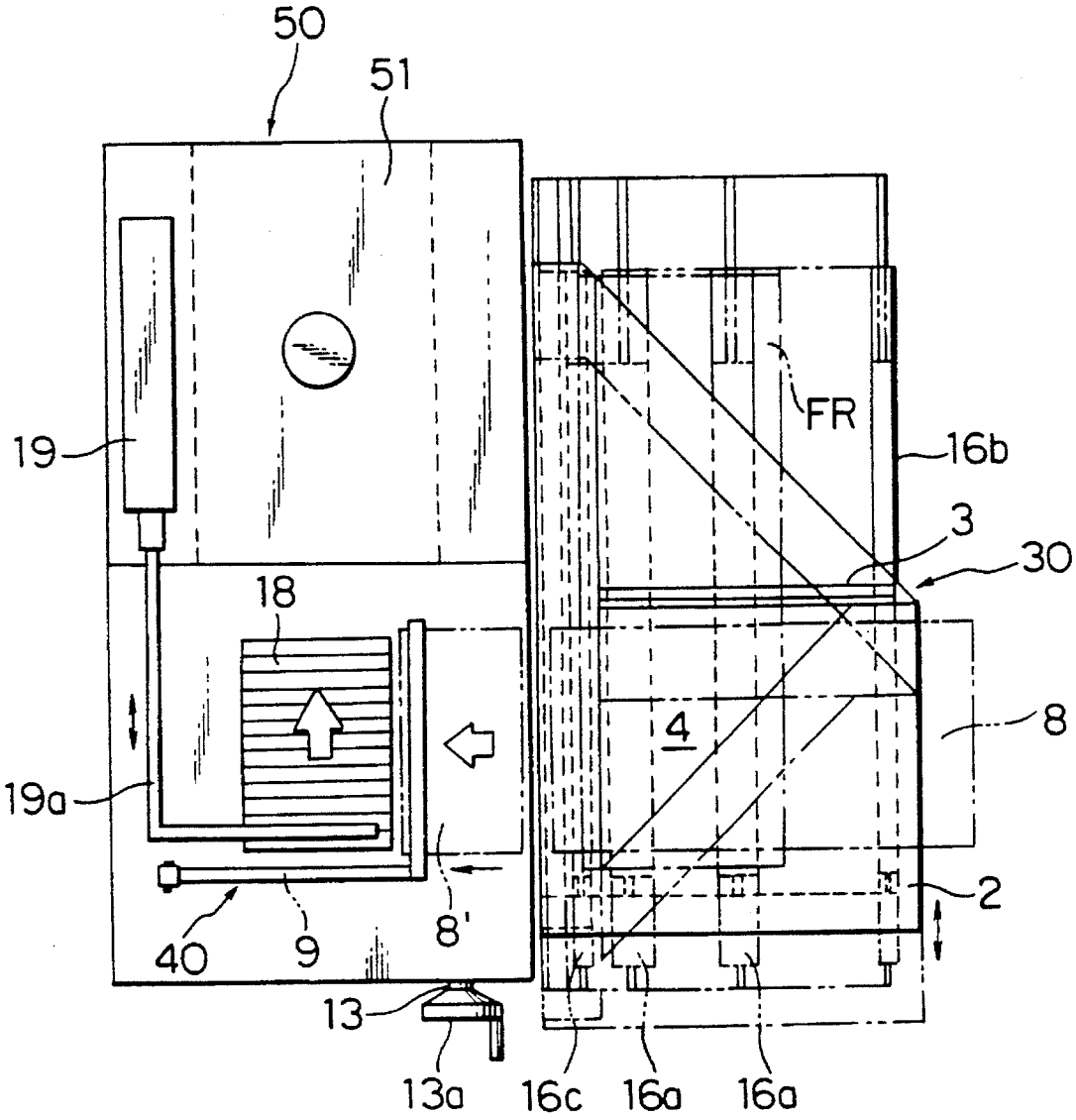
FIG. 8 is a plan view of the wrapping machine of FIG. 7.
Figure 9:
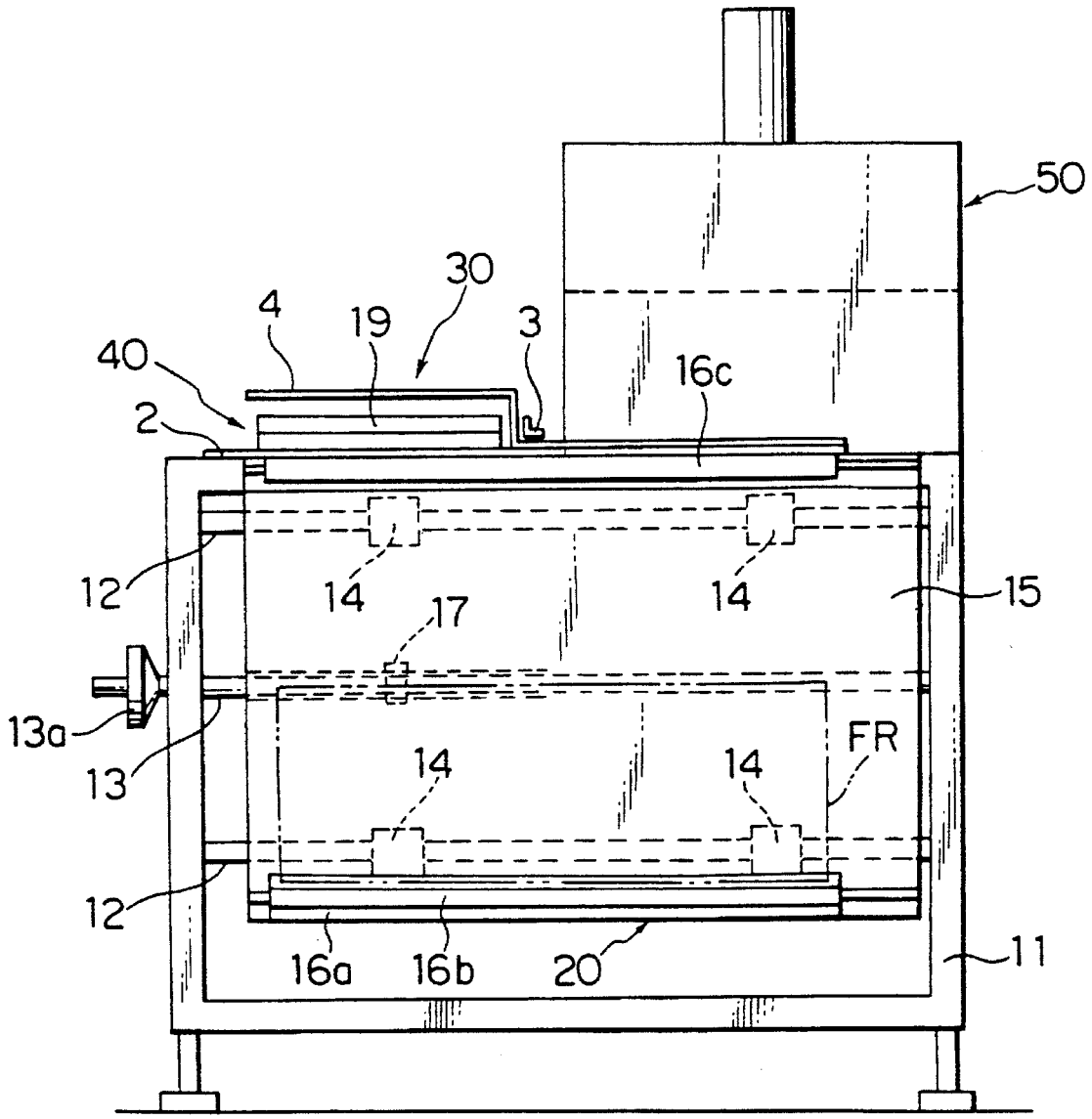
FIG. 9 is a rear view of the wrapping machine of FIG. 7.
Figure 10:
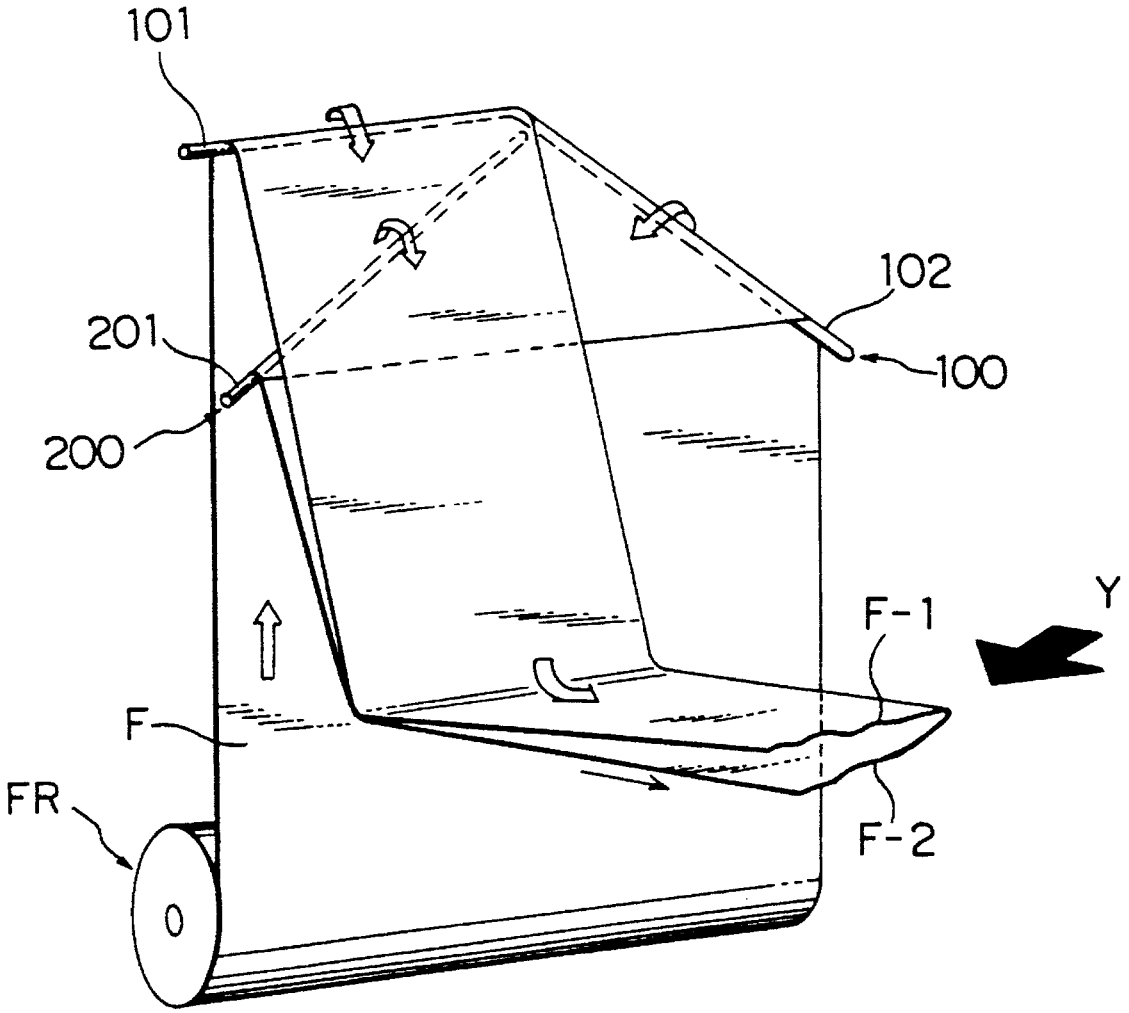
FIG. 10 PRIOR ART
FIG. 10 is a schematic view showing a conventional film folding mechanism.

FIGS. 7 through 9 shows another typical embodiment, in which the space for installation of all components of the wrapping machine 1 can be reduced to a minimum even though it includes a heat shrinking unit. FIG. 7 is a side view of the continuous wrapping machine 1, and FIGS. 8 and 9 are top and rear views, respectively, of the wrapping machine 1.

According to the second embodiment, the continuous wrapping machine 1 comprises a wide film supply device 20 of the above-mentioned construction, a film folding and opening device 30, a fusing and cutting device 40 for sealing the openings of the folded film around the accommodated article, and a heat shrinking device 50 for heat shrinking the film wrapping the article to produce a completely airtightly wrapped product. The fusing and cutting device 40 and the heat shrinking device 50 are arranged side by side on the top of a common housing 11, in which various driving and controlling devices are mounted. These driving and controlling devices are not characteristic parts of the invention and may be those now on the market, so their description is omitted here.

The wide film supply device 20 and the film folding and opening device 30 are situated rearwardly of the film inlet side of the housing 11 and is movable transversely of the film. In the illustrated example, between opposite vertical frames 11*a* of the rear side of the housing 11, two horizontal guide rods 12 are mounted and are spaced a predetermined distance vertically from each other. Substantially centrally between the upper and lower guide rods 12, a screw rod 13 is rotatably supported by the housing 11, extending parallel to the upper and lower rods 12. An operating handle 13*a* is attached to one end of the screw rod 13, projecting outwardly from the housing 11.

To the upper and lower guide rods 12, a support frame 15 of a generally horizontal U-shape cross section is connected via two slide blocks 14, respectively. On a lower frame portion 15*a* of the support frame 15, front and rear parallel film roll support rollers 16*a* are rotatably mounted, and a first film turning roller 16*b* also is mounted in parallel to and rearwardly of the film roll support rollers 16*a* substantially in a common plane. On the lower surface of the base of an upper frame portion 15*b*, a second film turning roller 16*c* is mounted parallel to the film roller support rollers 16*a* and the first film turning roller 16*b*. On the upper surface of the upper frame portion 15*b*, the film folding and opening device 30 is mounted. The rollers 16*a*–16*c* constitute the wide film supply device 20. The film folding and opening device 30 is substantially identical in construction with the film folding and opening device 1 of FIGS. 1 through 3, so its description is omitted here. In the folding and opening device 30, likewise the first embodiment, a conveyer belt 8 for articles is inserted.

From the outer surface of an intermediate frame portion 15*c* of the support frame 15, a frame moving block 17 having an internal screw is projecting, the internal screw of the block 17 being threadedly meshing with the screw rod 13 which is extending transversely and is rotatably mounted in the housing 11. As a result, when the screw rod 13 is turned clockwise and anticlockwise by operating the operating handle 13*a*, the support frame 15 is moved along the upper and lower guide rods 12 via the slide blocks 14. Namely, by operating the operating handle 13*a*, it is possible to move the wide film supply device 20 and the film folding and opening device 30 by a desired length transversely of the film between the solid-line position and the phantom-line position in FIG. 8 voluntarily and easily so that the processing width can be controlled in accordance with the film.

According to the illustrated example, the fusing and cutting device 40 on the upper surface of the half of the housing 11 on the downstream side of the folded film F has an L-type sealer 9. On the upper surface of the housing 11 where the L-type sealer 9 is mounted, a conveyer 8' is supported contiguously to the carrying end of the conveyer belt 8 in such a manner that its carrying surface is substantially flush with the carrying surface of the conveyer belt 8. At the central portion of the fusing and cutting device 40 contiguous to the conveyer 8', a roller conveyer 18, for example, is disposed perpendicularly to the film travelling path in such a manner that its carrying surface is substantially flush with that of the conveyer 8' and so as to convey wrapped articles transversely of the film travelling path. The heat shrinking device 50 mounted on the upper surface of the other half of the housing 11 has a shrink tunnel 51 having a known structure. Along the side surface of the front portion of the shrink tunnel 51, a fluid cylinder 19 is mounted. To an end of the rod of the cylinder 19, a conveyer arm 19*a* is attached for hooking the wrapped article, which has an L shape as viewed in plan, to convey the wrapped article into the shrink tunnel 51 from the fusing and cutting device 40.

As is understood from the foregoing description, in the second embodiment of FIGS. 7 through 9, utilizing that the film folding and opening device 30 has a virtually right-angled equilateral triangular shape as viewed in plan, the housing 11 has a width substantially equal to the inclined side of the triangle and a length a half of the width. 0n the upper surface of the half of the housing 11 situated downstream of the folded and opened film F, the fusing and cutting device 40 is disposed. On the upper surface of the other half of the housing 11, the heat shrinking device 50 is mounted. As a result, the whole continuous wrapping machine has a very compact structure.

For continuously producing airtightly wrapped products on the automatic continuous wrapping machine, firstly articles successively carried on the conveyer belt 8 are supplied into the film which has been folded continuously and is opened at the same time by the film folding and opening device 30. The individual article accommodated in the film is transferred to the conveyer 8', and the opening edges of the film are sealed by the L-type sealer 9. Then the cylinder 19 of the heat shrinking device 50 is activated to move the L-shape conveyer arm 19*a* toward the shrink tunnel 51 so that its distal end catches the wrapped article on the roller conveyer 18 to convey it into the shrink tunnel 51. While it is conveyed into the shrink tunnel 51, the wrapped article is gradually forwarded by a non-illustrated conveying device mounted in the shrink tunnel 51. During that time, the film wrapping the article will be shrunk to complete an airtightly wrapped product. When the wrapped article is conveyed into the shrink tunnel 51, the cylinder 19 is activated again to expand the conveyer arm 19*a*, returning to the waiting position. As the foregoing procedure is performed in order, airtightly wrapped products are completed one after another.

In the second embodiment of FIGS. 7 through 9, the continuous wrapping machine is operated fully automatically. Alternatively, the conveyer belt 8 and the conveyer 8' may be omitted, and the individual operating devices may be operated manually.

As is apparent from the foregoing description, according to the wrapping machine of this invention, since the film folding device and the folded-film opening device, which are separate in the prior art, are combined into a unitary device having a simple structure, it is possible to reduce the installation space to a minimum and it is possible to realize a compact wrapping machine, by connecting a sealing device directly to the wrapping machine., without taking up the folded film temporarily in roll. With the wrapping machine of this invention, it is possible to use a roll of continuous-length and wide film directly to enable full automation so that various kinds of troubles, which might be caused due to static electricity in taking up the film and adhesion of the film, can be eliminated. It is therefore possible to cope with a variety of films of different qualities, improving the rate of production remarkably.

What is claimed is:

1. A machine for wrapping an article with wrapping material, from a roll of continuous-length wrapping material, comprising:

a folding and opening unit for inverting the continuous-length wrapping material, which is drawn out horizontally from said roll, folding the drawn-out wrapping material longitudinally about its center line and, at the same time, holding the folded wrapping material open in a generally horizontal U-shape cross section;

means facing toward the inside of U-shape cross section for supplying an article to be wrapped to a position within said U-shape cross section; and means for fusing the longitudinal edge of the U-shape cross section, and for fusing and cutting a transverse edge across the U-shape cross section of the folded wrapping material supplied from said folding and opening unit.

2. A wrapping machine according to claim 1, wherein said folding and opening unit includes (i) an inverting guide having a straight inverting and guiding section transversely crossing a width of the wrapping material and having a length about a half of the width of the wrapping material, and a straight slant guiding section connected with one end of said inverting and guiding section and is inclined by about 45° thereto in a fixed horizontal plane, (ii) a raising guide included in the fixed horizontal plane defined by said inverting guide and arranged along a line crossing said one end of said inverting and guiding section for turning upward the wrapping material at about a right angle from the horizontal plane, and (iii) a folding guide situated upwardly of a substantially vertical plane which includes said raising guide and forming a substantially right-angled equilateral triangle which is located in a plane parallel to said fixed horizontal plane, said triangle has one side extending between a first apex and a second apex, said first apex on a straight line rising vertically at about 45° with respect to said horizontal plane from said one end of said inverting and guiding section and said second apex which is right-angled, and an inclined side extending from said first apex to a third apex.

3. A wrapping machine according to claim 2, wherein said folding guide has means for adjusting the position of said first apex on the straight line rising at about 45° in the vertical plane.

4. A wrapping machine according to claim 1, wherein said folding and opening unit further has means for adjustably positioning said folding and opening unit transversely of the wrapping material.

5. A wrapping machine according to claim 2, wherein said folding and opening unit further has means for adjustably positioning said folding and opening unit transversely of the wrapping material.

6. A wrapping machine according to claim 3, wherein said folding and opening unit further has means for adjustably positioning said folding and opening unit transversely of the wrapping material.

7. A wrapping machine according to claim 1, further comprising means for heat shrinking the fused wrapping material accommodating the article, wherein said wrapping material roll is situated under said folding and opening unit, and said fusing and cutting means downstream of said wrapping material roll and said heat shrinking means are arranged within the entire width of the wrapping material.

8. A wrapping machine according to claim 2, further comprising means for heat shrinking the fused wrapping material accommodating the article, wherein said wrapping material roll is situated under said folding and opening unit, and said fusing and cutting means downstream of said wrapping material roll and said heat shrinking means are arranged within the entire width of the wrapping material.

9. A wrapping machine according to claim 3, further comprising means for heat shrinking the fused wrapping material accommodating the article, wherein said wrapping material roll is situated under said folding and opening unit, and said fusing and cutting means downstream of said wrapping material roll and said heat shrinking means are arranged within the entire width of the wrapping material.

10. A wrapping machine according to claim 4, further comprising means for heat shrinking the fused wrapping material accommodating the article, wherein said wrapping material roll is situated under said folding and opening unit, and said fusing and cutting means downstream of said wrapping material roll and said heat shrinking means are arranged within the entire width of the wrapping material.

11. A wrapping machine according to claim 1, wherein said fusing and cutting means is an L-type sealer for fusing and cutting the opening edges of the folded wrapping material in L shape simultaneously.

12. A wrapping machine according to claim 2, wherein said fusing and cutting means is an L-type sealer for fusing and cutting the opening edges of the folded wrapping material in L shape simultaneously.

13. A wrapping machine according to claim 3, wherein said fusing and cutting means is an L-type sealer for fusing and cutting the opening edges of the folded wrapping material in L shape simultaneously.

14. A wrapping machine according to claim 4, wherein said fusing and cutting means is an L-type sealer for fusing and cutting the opening edges of the folded wrapping material in L shape simultaneously.

15. A wrapping machine according to claim 5, wherein said fusing and cutting means is an L-type sealer for fusing and cutting the opening edges of the folded wrapping material in L shape simultaneously.

* * * * *